US006208261B1

(12) United States Patent
Olstead

(10) Patent No.: US 6,208,261 B1
(45) Date of Patent: Mar. 27, 2001

(54) USE OF VISUAL BUILDING ALARM SYSTEM TO DISPLAY PUBLIC INFORMATION TO BUILDING VISITORS

(76) Inventor: John Olstead, 244 Exchange St., Millis, MA (US) 02054

( * ) Notice: Subject to any disclaimer, the term of this patent is extended or adjusted under 35 U.S.C. 154(b) by 0 days.

(21) Appl. No.: 09/569,930

(22) Filed: May 13, 2000

(51) Int. Cl.[7] ..... G08B 7/00

(52) U.S. Cl. ..... 340/691.6; 340/693.5; 340/691.5; 340/541

(58) Field of Search ..... 340/691.6, 693.5, 340/691.5, 541; 4/446

(56) References Cited

U.S. PATENT DOCUMENTS 4,212,003 * 7/1980 Mishoe et al. ..... 340/574
4,381,505 * 4/1983 Dion ..... 345/33
5,539,393 * 7/1996 Barfod ..... 340/825.52
5,966,069 * 10/1999 Zmurk et al. ..... 340/330

* cited by examiner

*Primary Examiner*—Benjamin C. Lee
(74) *Attorney, Agent, or Firm*—Robert Nathans

(57) ABSTRACT

A public building alarm system for displaying information relating to potential alarm conditions within or about a public building area, employs an alarm condition display screen for informing a fireman, for example, of the nature and location of a possible fire. For the vast majority of the time, in the absence of an alarm condition, display control circuitry causes the alarm display screen to display information of general interest to the public, in high traffic areas of the building frequented by persons visiting the building. This is in contrast with alarm conditions of no interest to the general public. Such information can include advertising, enabling the building owner to collect advertising revenues to help offset the cost of the alarm system. Upon the occurrence of an alarm condition, the alarm condition display is immediately substituted for the information of general interest display. A fireman or building operator can also produce this substitution by means of a prominent "system test" button adjacent the display.

20 Claims, 1 Drawing Sheet

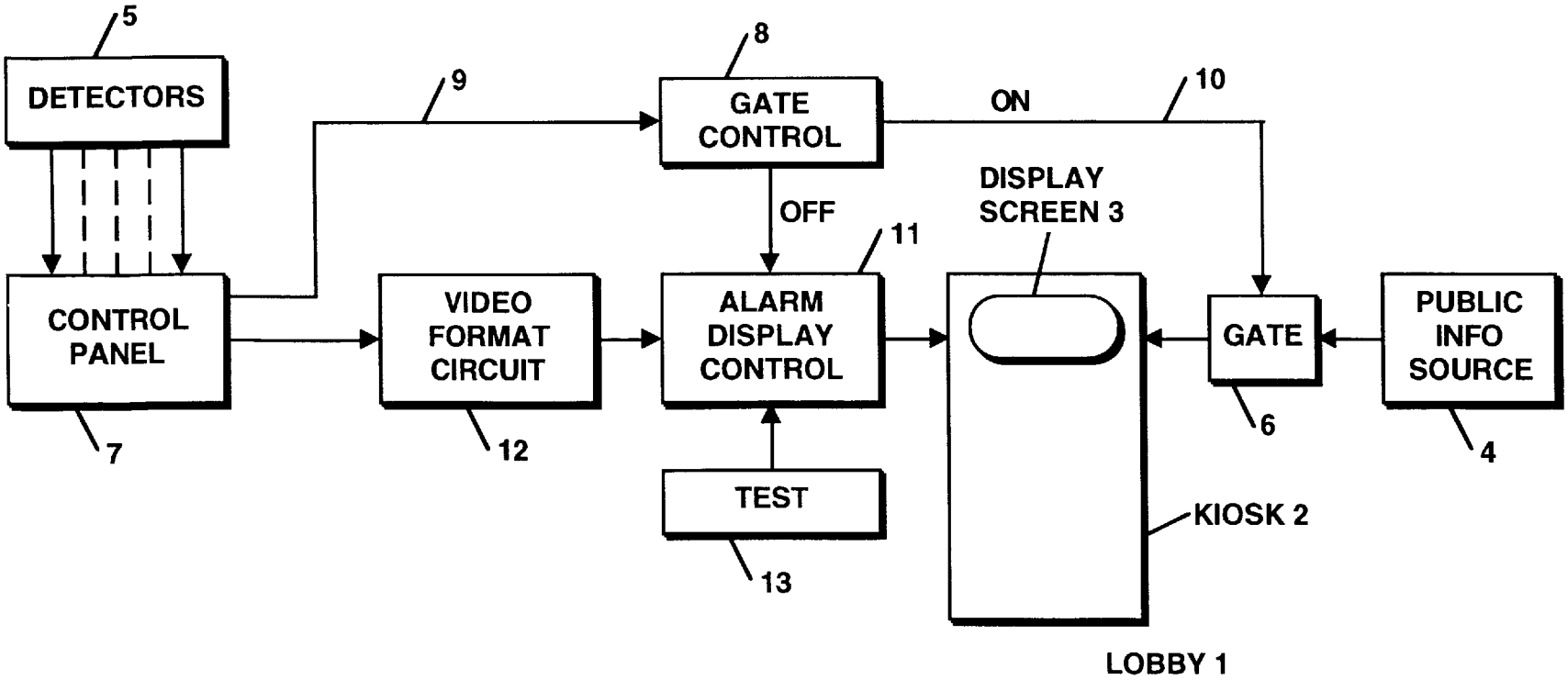
PUBLIC INFO SOURCE
4
GATE
6
KIOSK 2
LOBBY 1
10
ON
DISPLAY SCREEN 3
11
GATE CONTROL
8
OFF
ALARM DISPLAY CONTROL
TEST
13
VIDEO FORMAT CIRCUIT
12
9
DETECTORS
5
CONTROL PANEL
7

USE OF VISUAL BUILDING ALARM SYSTEM TO DISPLAY PUBLIC INFORMATION TO BUILDING VISITORS

BACKGROUND OF THE INVENTION

Most public buildings require a fire alarm annunciator or visual alarm display (VAD) to be provided in an easily accessible location. The display is used for information purposes by a fireman, called to the building due to the detection of a possible fire alarm condition. The visual alarm display (hereinafter VAD) indicates critical systems information such as for example, the location of a possible fire, the failure of an HVAC (heating, ventilation, air-conditioning) component and its location, or a break in and its location, due to a burglar, the latter systems information being used by the police rather than the fire department. Heat sensors, smoke or other detectors scattered throughout large buildings are typically connected to a control panel, which can be located in a control room or security office. Some control panels are electrically coupled to a CRT video display screen which functions as the aforesaid visual alarm display VAD mentioned above, for advantageously visually indicating the geographical area layout and location and the type of alarm sensor generating the alarm condition. These types of public building alarm systems are disclosed in U.S. Pat. No. 5,189,394, issued to Walter et al., incorporated by reference herein.

The VAD, although generally required in a large public building to aid the fire or police department personal, summoned to the building during an emergency, is usually not noticed by the public visitors to the building. Although the VAD must be readily accessible to such fire and police department personnel, it is often wall mounted and off to the side, rather than being positioned in a prominent place in the lobby or entrance area.

SUMMARY OF PREFERRED EMBODIMENTS OF THE INVENTION

Accordingly, the aforesaid VAD is rarely in use, since the generation of alarm conditions only occurs during a small percentage of the time. In accordance with the present invention, I use the VAD, during normal or idle time when no alarm condition exists, to display general information of interest to visitors to the public building, such as corporate information provided by tenants in an office building, public service messages, stock market and weather reports, ball game scores, the building directory of a large shopping mall having constantly changing tenants and special sales by mall tenants, or any other general information of interest to the public. The operator of the office building or shopping mall could also display other general information such as advertising, to obtain income which could help pay for the cost and maintenance of the alarm system, which could facilitate distributor sales of the alarm systems.

Upon the generation of an actual alarm condition, the alarm condition visual display is immediately enabled, over riding the display of general information of interest to the public, and is used in the usual manner as explained above, by the fire or police department to locate and proceed to the area where the alarm condition is occurring. In view of the required reliability of the VAD, a test/over-ride button actuated relay or bypass gate is provided so that the system would be tested from time to time, to manually over-ride the public general information display and display the various alarm stations being monitored. A fireman responding to an alarm call could also over ride the public information display with this same test button, should a relay become stuck or a switching circuit fail to operate.

BRIEF DESCRIPTION OF THE DRAWINGS

The various features and advantages of the invention will become more apparent upon study of the following description, taken in conjunction with the drawing in which the sole FIGURE schematically illustrates a preferred embodiment of the invention.

DETAILED DESCRIPTION OF PREFERRED EMBODIMENTS OF THE INVENTION

Referring now to the sole figure, kiosk 2 is provided in a high traffic area of a building such as the lobby 1 of an office building or central area of a shopping mall or airport. A visual display screen 3 is formed within the kiosk for providing the information of general interest most of the time as described above. The general information originates from internet or other public information source 4, coupled to the display 3, via normally open or enabled gate 6. This is indicated by an "on" condition on lead 10.

A prior art array of alarm detectors 5, such as fire or smoke detectors, HVAC fault detectors, burglary detectors or the like, are typically coupled to control panel 7, which in turn is coupled to video display format circuitry 12 for formatting an appropriate alarm condition signal to be displayed by display screen 3. The latter signal could represent a map of various building locations, icons of equipment therein and alarm conditions as in the prior art. As well known in this alarm art, the display formatting circuitry 12 could comprise a microprocessor or PC with appropriate software. See the following patents incorporated by reference.

In U.S. Pat. No. 5,237,305 to Ishikuro, a system is described in column 1, that displays various rooms, appliances, and windows of the rooms in a house. Upon the detection of an alarm condition such as a burglar breaking a window, a fire or gas leak etc., a security screen to be viewed, over rides the normal viewed screen, to display (announce) the detected alarm condition. U.S. Pat. No. 5,475,364 to Kenet, is somewhat like the Ishikuro teaching in that displayed rooms with their heating/cooling components are displayed and alarm conditions such as sensed smoke and fire are also displayed upon the sensing of an alarm condition. However, these two patents are not directed to alarm systems for public buildings, and information of interest to the public visiting the public buildings, involved in the present invention.

The remaining components illustrated, relate to the screen display control system for causing the kiosk screen display 3 to display the formatted alarm condition, which can be in map format, in response to the production of an alarm condition signal, transmitted over alarm bus 9 from control panel 7, which activates gate control circuit 8, to in turn enable and open alarm display gate 11, and cause the formatted alarm display data to be forwarded to the display screen 3. At this time, gate control circuit 8 disables or closes the public information gate 6, via conductor 10, to block farther transmission of the general interest data to the kiosk display screen. A test or fireman's over-ride device 13 should be provided, to pent periodic testing to ensure that the system is operating properly and that no components are functioning improperly; e.g. a stuck relay.

Since variations of the foregoing will readily occur to workers in the alarm design art, the scope of the invention is to be restricted solely to the terms of the following claims and art recognized equivalents thereof.

I claim:

1. A building alarm system for displaying information of general interest in addition to alarm conditions comprising:

(a) alarm condition detection means for producing an alarm condition signal upon the occurrence of a building system alarm condition;

(b) display means for displaying said information of general interest in areas of said building frequented by persons within said building;

(c) display format means for producing a display formatted alarm condition signal for display by said display means; and (d) display control means for causing said display means to display said formatted alarm condition signal in response to the production of said alarm condition signal by said alarm condition detection means.

2. The alarm system of claim 1 wherein said display means includes a display screen and said display control means includes means for filling at least a substantial portion of said display screen with said formatted alarm condition signal in response to the production of said alarm condition signal.

3. The alarm system of claim 2 wherein said building is an office building, and said display means displays information including current building tenants or advertising.

4. The alarm system of claim 2 wherein said building is a shopping mall and said display means displays information relating to the location of mall tenants or current sales information.

5. The alarm system of claim 2 wherein said general interest information is selected from the group consisting essentially of news, advertising, stock market conditions, weather, tenant information, sales information and advertising.

6. The alarm system of claim 1 wherein said building is an office building, and said display means displays information including advertising.

7. The alarm system of claim 1 wherein said building is a shopping mall and said display means displays information relating to the location of mall tenants or current sales information.

8. The alarm system of claim 1 wherein said information of general interest is selected from the group consisting essentially of news, advertising, stock market conditions, weather, tenant information, current sales information and advertising.

9. A building alarm system for displaying information relating to potential alarm conditions within a building area comprising:

(a) alarm condition display means for displaying information relating to alarm conditions within said building;

(b) general information source means coupled to said alarm condition display means for causing said alarm condition display means to display information of general interest, in the absence of an alarm condition, in areas of said building frequented by persons within said building;

(c) alarm condition detection means for producing an alarm detection signal upon the occurrence of a building system alarm condition; and (d) display control means coupled to said alarm condition display means for producing an alarm condition display thereon upon the production of said alarm detection signal.

10. The alarm system of claim 9 wherein said display means includes a display screen and said display control means includes means for filling at least a substantial portion of said display screen with said alarm condition display in response to the production of said alarm detection signal.

11. The alarm system of claim 10 wherein said building is an office building, and said display means displays information including news or advertising.

12. The alarm system of claim 10 wherein said building is an office building, and said display means displays information relating to current building tenants.

13. The alarm system of claim 10 wherein said building is a shopping mall and said display means displays information relating to the location of mall tenants or current sales being conducted.

14. The alarm system of claim 9 wherein said building is an office building, and said display means displays information including news or advertising.

15. The alarm system of claim 9 wherein said building is an office building, and said display means displays information relating to current building tenants.

16. The alarm system of claim 9 wherein said building is a shopping mall and said display means displays information relating to the location of mall tenants or current sales being conducted.

17. The alarm system of claim 9 wherein said alarm condition display means is positioned within a kiosk.

18. The alarm system of claim 9 wherein said information of general interest is selected from the group consisting essentially of news, advertising, stock market conditions, weather, tenant information, current sales information and advertising.

19. A method comprising the steps of:

(a) providing a building alarm system for producing a visual alarm condition display upon an alarm display screen, in response to the production of an alarm condition within said building;

(b) positioning said alarm display screen within a high traffic area of said building;

(c) causing said alarm display screen to display general interest information of interest to persons passing through said high traffic area; and (d) replacing at least a major portion of information of general interest being displayed upon said screen with alarm condition information upon the production of said alarm condition.

20. The method of claim 19 wherein said general interest information is selected from the group consisting essentially of news, advertising, stock market conditions, weather, tenant information, sales information and advertising.

* * * * *